US008485174B2

(12) United States Patent
Bissonnette et al.

(10) Patent No.: US 8,485,174 B2
(45) Date of Patent: Jul. 16, 2013

(54) BALL LAUNCHER

(75) Inventors: Laurent Bissonnette, Fairhaven, MA (US); Michael McNamara, Fairhaven, MA (US)

(73) Assignee: Acushnet Company, Fairhaven, MA (US)

( * ) Notice: Subject to any disclaimer, the term of this patent is extended or adjusted under 35 U.S.C. 154(b) by 844 days.

(21) Appl. No.: 12/556,663

(22) Filed: Sep. 10, 2009

(65) Prior Publication Data

US 2011/0056473 A1 Mar. 10, 2011

(51) Int. Cl.
*F41B 4/00* (2006.01)
*A63B 69/40* (2006.01)

(52) U.S. Cl.
CPC ..... *F41B 4/00* (2013.01); *A63B 69/406* (2013.01)
USPC ..... 124/81; 124/1; 124/6; 124/78; 124/82; 473/422; 73/65.03

(58) Field of Classification Search
CPC ..... F41B 4/00; A63B 69/406
USPC ..... 124/1, 6, 78, 81, 82; 473/422; 73/65.03
See application file for complete search history.

(56) References Cited

U.S. PATENT DOCUMENTS

| | | | | | |
|---|---|---|---|---|---|
| 3,299,692 | A * | 1/1967 | Mizejewski | ..... | 73/12.02 |
| 4,372,284 | A * | 2/1983 | Shannon et al. | ..... | 124/78 |
| 4,570,607 | A * | 2/1986 | Stokes | ..... | 124/56 |
| 4,922,885 | A * | 5/1990 | Iwabuchi et al. | ..... | 124/78 |
| 5,046,476 | A * | 9/1991 | Nozato | ..... | 124/78 |
| 5,359,986 | A * | 11/1994 | Magrath et al. | ..... | 124/78 |
| 5,722,384 | A * | 3/1998 | Cox | ..... | 124/78 |
| 6,082,350 | A * | 7/2000 | Crews et al. | ..... | 124/78 |
| 6,285,445 | B1 * | 9/2001 | Winfield et al. | ..... | 356/28 |
| 6,286,364 | B1 * | 9/2001 | Aoyama et al. | ..... | 73/65.03 |
| 6,440,013 | B1 * | 8/2002 | Brown | ..... | 473/422 |
| 6,443,140 | B1 * | 9/2002 | Crews et al. | ..... | 124/78 |
| 6,758,759 | B2 * | 7/2004 | Gobush et al. | ..... | 473/131 |
| 6,781,621 | B1 * | 8/2004 | Gobush et al. | ..... | 348/157 |
| 7,082,938 | B2 * | 8/2006 | Wilmot | ..... | 124/78 |
| 7,143,639 | B2 * | 12/2006 | Gobush | ..... | 73/65.03 |
| 7,369,158 | B2 * | 5/2008 | Gobush et al. | ..... | 348/169 |
| 7,383,832 | B2 * | 6/2008 | Soberg | ..... | 124/6 |
| 7,395,696 | B2 * | 7/2008 | Bissonnette et al. | ..... | 73/65.03 |
| 7,766,770 | B2 * | 8/2010 | Cucjen et al. | ..... | 473/422 |
| 7,806,788 | B1 * | 10/2010 | Neuman | ..... | 473/451 |
| 7,849,725 | B1 * | 12/2010 | Nelson et al. | ..... | 73/12.05 |
| 8,016,688 | B2 * | 9/2011 | Gobush | ..... | 473/131 |
| 8,133,137 | B2 * | 3/2012 | Grant et al. | ..... | 473/451 |
| 2003/0004017 | A1 * | 1/2003 | Brown | ..... | 473/422 |
| 2003/0195061 | A1 * | 10/2003 | Brown | ..... | 473/415 |
| 2006/0236993 | A1 * | 10/2006 | Cucjen et al. | ..... | 124/78 |

OTHER PUBLICATIONS

Wilson Ultra Ball Launcher (article from Golf Digest, Jan. 1999).

* cited by examiner

*Primary Examiner* — Gene Kim
*Assistant Examiner* — Alexander Niconovich
(74) *Attorney, Agent, or Firm* — Smith, Gambrell & Russell, LLP

(57) ABSTRACT

The present invention generally relates to an automated ball launching method and apparatus. The apparatus includes ball pick and place mechanisms, an air cannon, spin and velocity inducing belt drive assemblies, electric leveling jack stands, electric angle linear drive, and a computer control system. The apparatus is capable of automatically controlling ball spin, velocity, and launch angle.

24 Claims, 4 Drawing Sheets

BALL LAUNCHER

FIELD OF THE INVENTION

The present invention relates to an automated golf ball launcher for aerodynamics testing. More specifically, the present invention relates to a system and method that launches a golf ball according to predetermined launch conditions.

BACKGROUND OF THE INVENTION

The field of golf ball manufacturing is constantly evolving into a more precise science. Improvements in material sciences, aerodynamics, and golf ball construction have all led to a golf ball that provides better playing characteristics for a golfer. One of the most basic innovations in golf was the discovery of the advantageous aerodynamic properties of a dimpled golf ball. As golf ball design has improved, manufacturers have been able to develop dimple configurations that maximize aerodynamic efficiency. For instance, it is often desirable to design a golf ball to have a specific coefficient of lift or drag in order to design a golf ball that flies as far as possible.

In order to foster further innovation in the field of golf ball manufacturing, however, it is important to accurately and precisely be able to launch a golf ball with known launch properties such as speed, spin, and angle. Among the most rudimentary and antiquated systems for launching golf balls are crude mechanical devices that swing a golf club towards a golf ball along a known swing path. This allows golf ball manufacturers to repeatedly test different golf balls using a known and reproducible swing. Such systems, however, allow for little control of spin, angle, slice, and other characteristics of a golf swing that typically take place on the golf course.

As technology has evolved, more advanced systems have been designed to launch golf balls at a controlled velocity, angle, and spin for the purpose of measuring the flight and aerodynamic coefficients of a golf ball. However, even current systems suffer from maintenance, safety, lack of precision, limited operational range, and automation issues. Accordingly, a continuing need exists for a golf ball launcher that can accurately control golf ball launch conditions more accurately and precisely. Moreover, a continuing need exists for a golf ball launcher that has a greater operating range that completely maps the range of golf ball flight. Finally, there is a need for a golf ball launcher with a simplified operation that minimizes the amount of manual intervention necessary.

SUMMARY OF THE INVENTION

The present invention is directed toward an apparatus for launching a ball. The apparatus includes a computer system or similar device to receive, store and execute a plurality of user determined launch parameters. In addition, the apparatus includes a loading system capable of automatically loading a plurality of balls into an air cannon while maintaining the ball orientation. The air cannon is positioned to shoot a ball into an adjustable passage between at least two belts.

The belts impart velocity and spin to launch the ball. The belts are coupled to a plurality of belt drives, which are controlled by the computer system or similar device to operate at a desired speed. In addition, the height of the belt drives is adjustable to form the adjustable passage. In one embodiment, a driving wedge system coupled to the belt drives to adjust the size of the passage. The belts may be of such construction as to maintain the belts integrity through linear or rotational speeds of at least 300 fps. In addition, the belts may include friction enhancing compounds, which aid in the belts adhesion to the drive pulleys. In one embodiment, a redundant belt drive system is coupled to the belt drive, to aid in assuring uniform drive speed. In another embodiment, a belt tensioner may be employed in such a method as to not require alteration of the belt drive system.

The user may input various launch parameters including launch angle, velocity, and spin rate. The launch angle may be controlled by a plurality of automatically controlled electric jacks capable of pivoting the launch angle by more than about 30 degrees. The pivot point is preferably located in the proximity of the ball launch location. In one embodiment, the electric jacks are capable of pivoting the launch angle from about −15° to about 35° relative to a horizontal surface.

The apparatus may be automatically adjustable to impart backspin of at least about 5000 rpm at a velocity of about 50 mph to about 225 mph. In addition, the apparatus is automatically adjustable to impart backspin of at least about 2500 rpm at a velocity of about 50 mph to about 225 mph. Preferably, the apparatus is automatically adjustable to launch a ball at a velocity of between about 35 mph and 330 mph.

The apparatus is capable of precisely firing a plurality of balls within certain tolerances. For example, a plurality of balls may be launched at a predetermined velocity within a tolerance of less than +/−2 mph. In one embodiment, the plurality of balls are launched at a predetermined velocity with a tolerance of +/−1 mph. In another embodiment, the plurality of balls are launched at a predetermined velocity with a tolerance of +/−0.5 mph. In addition, a plurality of balls may be launched at a predetermined spin rate within a tolerance of less than +/−6%. In one embodiment, the plurality of balls are launched at a predetermined spin rate within a tolerance of less than +/−5%. In another embodiment, the plurality of balls are launched at a predetermined spin rate within a tolerance of less than +/−4%.

The apparatus is capable of precisely firing a plurality of balls within certain repeatability. For example, a plurality of balls may be launched at a predetermined velocity with a repeatability of less than +/−0.2 mph. In one embodiment, the plurality of balls are launched at a predetermined velocity with a repeatability of less than +/−0.15 mph. In another embodiment, the plurality of balls are launched at a predetermined velocity with a repeatability of less than +/−0.1 mph. In addition, a plurality of balls may be launched at a predetermined spin rate with a repeatability of less than +/−2%. In one embodiment, the plurality of balls are launched at a predetermined spin rate with a repeatability of less than +/−1%. In another embodiment, the plurality of balls are launched at a predetermined spin rate with a repeatability of less than +/−1%.

The apparatus may include a velocity sensor operatively connected to the computer system or similar device. In addition, the apparatus may include a spin sensor operatively connected to the computer system or similar device.

The present invention is also directed at a method for launching a ball. The method includes inputting a plurality of parameters into a computer. These parameters may include ball velocity, ball spin, launch angle, and number of balls to be launched. Next, the balls are loaded in a preset orientation. Then, a start-test is engaged, wherein the parameters, controlled by computer, begin sequence loading the balls into an air cannon while maintaining a preset orientation. The air cannon is controlled to fire the plurality of balls at a user inputted speed. The air cannon is fired into an adjustable passage formed by at least two belts operating on separate belt drives. The speed of the belts is controlled by the computer and corresponds to the user inputted speed and spin. At any time, the launch angle may be pivoted to desired position from about −15° to about 35° relative to a horizontal surface.

In one embodiment, a plurality of balls may be launched at a predetermined velocity within a tolerance of less than +/−4 mph. In addition, a plurality of balls may be launched at a predetermined spin rate within a tolerance of less than +/−6%. The computer system or similar device may automatically adjust the speed of the belts when a velocity or spin sensor indicates a velocity or spin that is out of the tolerance range.

BRIEF DESCRIPTION OF THE DRAWINGS

Further features and advantages of the invention can be ascertained from the following detailed description that is provided in connection with the drawings described below.

DETAILED DESCRIPTION OF THE PREFERRED EMBODIMENTS

Figure 1:
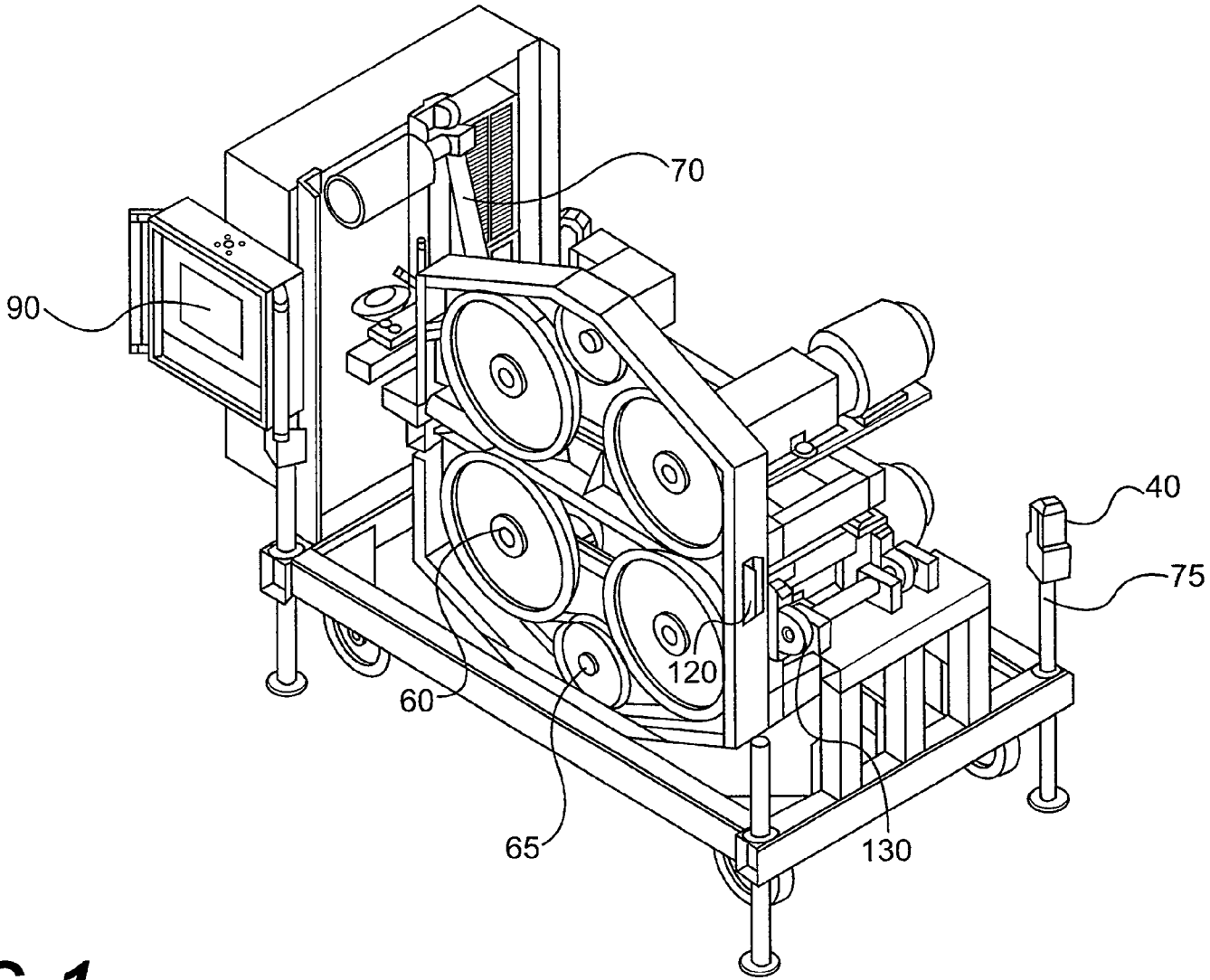
FIG. 1 is a front orthogonal view showing one exemplary embodiment of the apparatus of the present invention.

Other than in the operating examples, or unless otherwise expressly specified, all of the numerical ranges, amounts, values and percentages in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

The present invention generally relates to an automated ball launching method and apparatus. As discussed in detail below, the apparatus includes; ball pick and place mechanisms 10, an air cannon 20, spin and velocity inducing belt drive assemblies 60, electric leveling jack stands 75, electric angle linear drive 70, and a computer control system 90. The apparatus is preferably used to propel a golf ball via an air cannon into a pair of drive belts. The air cannon pressure is selected to fire the ball between the belts at a mean belt speed.

In addition, a velocity sensor mounted at the cannon muzzle provides feedback for ball launch speed control. Preferably, the translational velocity of the drive belts is controlled to obtain alternative ball speed and ball spin rates, and the electric angle linear motor and integral inclinometer are used to set launch angles. It is desirable for the system to be pre-programmed with a series of desired launch conditions and the number of balls to be fired at each condition. According to one aspect, the system will automatically fire the desired sequence. Because it is desirable to minimize the manual operation necessary, it is preferred that the only manual intervention necessary to use the automated ball launcher is the placement and/or orientation of the balls in the feeder tray.

Mechanical System

As discussed above and shown in FIG. 1, one aspect of the present invention includes a propulsion system. In one embodiment, it is desirable for the propulsion system to include a belt drive system. The belt drive system may include one drive assembly 60, or it may include multiple assemblies. For example, in one embodiment, the belt drive system includes at least two drive assemblies. One exemplary purpose of the belt drive system is to control ball speed and ball spin.

Figure 3:
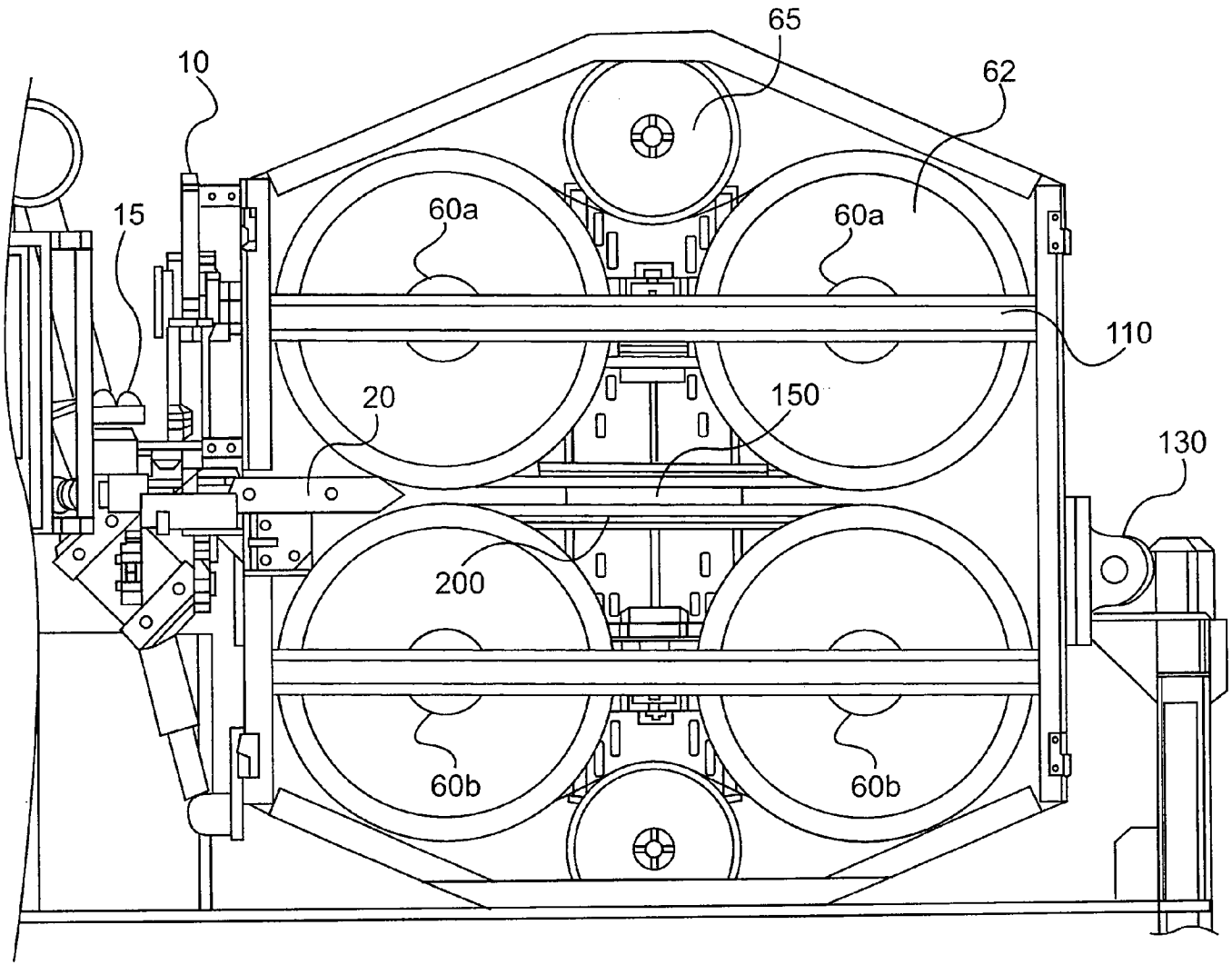
FIG. 3 is a front view of an exemplary embodiment of the apparatus of the present invention.

As shown in FIG. 3, two drive assemblies 60*a*, 60*b* are preferably included in one embodiment of the present invention. The drive assemblies are preferably positioned such that they form a passage 150 between them. In other words, the drive assemblies oppose each other. In this manner, a passage is created between belts 200 of each of belt drive assemblies 60*a*, 60*b*. One advantage of forming a passage in this manner is that an object, such as a golf ball, may have a desired velocity and spin imparted to it as it passes between the belts.

One way to describe passage 150 is by the distance between belts 200 of belt drive assemblies 60*a*, 60*b*. This passage is adjustable to accommodate a variety of diameters. Preferably, passage 150 is between about 0.5 inches and about 1 inches. More preferably, passage 150 is between about 0.25 inches and about 1.5 inches. Most preferably, passage 150 is between about 0.1 inches and about 2.0 inches. Alternately, passage 150 may preferably be about 0.5 inches or less, and more preferably may be about 1 inch or less. Most preferably, however, passage 150 is about 2 inches or less. In other embodiments, passage 150 is preferably about 0.1 inches or greater, and more preferably about 1.5 inches or greater.

In one embodiment, each of belt drive assemblies 60 include a drive belt that interacts with at least two drive pulleys 62, as shown in FIG. 3. The drive belt of each drive belt system interacts with the periphery of drive pulleys 62 such that the velocity of belt 200 is controlled by the rotational speed of pulleys 62. In this manner, the translational velocity of belts 200 may be controlled. Optionally, a third tensioning pulley 65 may be included with each of belt drive systems 60 to provide tension to drive belt 200 and to control the velocity of drive belt 200. The tensioning pulley provides several advantages, including reducing the downtime when a belt change is necessary.

One way the tensioner provides this advantage, is by avoiding disturbing the main drive pulleys shafts. When belts are changed, tensioner pulley 65 mounts are simply loosened, and then belt 200 is removed, replaced, then re-tensioned. Without a tension pulley 65, main drive pulley shafts would require adjustment which would invariably cause misalignment and cause the belt to track improperly. A lengthy process of re-aligning is averted by simply using a tensioner. In addition, bearing maintenance may also be performed more quickly. One way that the tensioner provides this advantage is by eliminating the need for main drive shaft adjustment. Without a tensioner, the main drive shafts must alter position to provide for belt removal before shafts can be removed for maintenance. Should bearings require maintenance, shafts mounts may now be precisely located in place by dowels or other devices, facilitating exact location upon replacement. This eliminates the need for a lengthy re-alignment procedure.

Other belts, wheels, bearings, and other mechanical devices known to those skilled in the art may also be added as desired. One example of a mechanical device that may also be included is a drive shaft for rotating the two drive pulleys of the belt drive system. The drive shaft preferably comprises safety devices that enhance the retaining ability of the present invention. Examples of safety devices that may be included are jam nuts and snap rings, although other safety devices known to those skilled in the art may also be used. Preferably, in addition, ceramic shaft bearings are included because of their long life and minimal maintenance requirements.

As mentioned above, each of the belt drive assemblies preferably includes at least two drive pulleys 62. It is desirable for drive pulleys 62 to comprise the same diameter. When the optional third tensioning pulley 65 is included, its diameter may be less than the diameter of the two drive pulleys 62. In one aspect, the diameter of the drive pulleys 62 is preferably about 2 feet or greater. More preferably, the diameter of the drive pulleys 62 is about 1.5 feet or greater. Most preferably, the diameter of the drive pulleys 62 is about 1.0 foot or greater.

In an alternate embodiment, the diameter or the drive pulleys 62 is preferably between about 1 foot and about 5 feet. More preferably, the diameter of the drive pulleys 62 is between about 1 foot and about 3 feet. Most preferably, the diameter of the drive pulleys 62 is between about 1 foot and about 2.5 feet. Those skilled in the art will recognize that the width of the drive pulleys 62, while not specifically described herein, may be adjusted such that it is the same as or slightly larger than the width of the drive belts 200.

Those skilled in the art will also recognize that the diameter of optional third tensioning pulley 65 may also be varied. For example, in one embodiment the diameter of third tensioning pulley 65 is preferably about 36 inches or less. More preferably, the diameter of third tensioning pulley 65 is about 24 inches or less. Most preferably, the diameter of third tensioning pulley 65 is about 16 inches or less.

Another way to describe the diameter of third tensioning pulley 65 is relative to the diameter of drive pulleys 62. Preferably, the diameter of third tensioning pulley 65 is about ⅞ of the diameter of drive pulleys 62. More preferably, the diameter of third tensioning pulley 65 is about ¾ of the diameter of drive pulleys 62. Most preferably, the diameter of third tensioning pulley 65 is about ½ of the diameter of the drive pulley 62.

Each of the drive belts 200 may include any material known to those skilled in the art. For instance, the drive belt may include rubber, leather, urethane, PVC, wire meshes that include metals including stainless steel and carbon steel, and fabric weaves that may include Kevlar® or Carbon fiber. It may be desirable for the drive belts to include a friction inducing surface that assists with movement of an object through the passage. The friction inducing surface may be generated by causing one or both sides of each of the drive belts 200 to have a textured or grooved surface. The textured surface preferably aides in preventing slippage between the object and the drive belt. Preferably, the textured surface has a coefficient of friction greater than about 0.7. In another embodiment, the coefficient of friction of the textured surface is greater than about 0.8.

In one embodiment, the drive belt has two exterior surfaces, at least one of which includes friction enhancing compounds or a composition to aid in the adhesion of the belt to the drive pulleys and/or golf balls. For example, in this aspect of the invention, a suitable drive belt may include a first exterior surface that includes friction enhancing compounds to aid in the adhesion of the belt to the drive pulleys. In addition, a second exterior surface, which contacts the golf balls as they are propelled through the system, may also include friction enhancing compounds. In particular, the friction enhancing compounds used in the second exterior surface of the drive belt are preferably non-marring. A variety of friction enhancing materials may be used for the exterior surfaces of the drive belt including, but not limited to, natural rubber, such as Linatex, urethane foam, or neoprene sponge may be used.

The drive belt may include an interior layer (or layers) that includes durable compounds and fibers to aid in the extending the life of the belt surface that contacts the ball and also prevent stretch. Examples of durable compounds and fibers for use in the interior layer of the drive belt include, but are not limited to, nylon, meta- and para-aramid synthetic fibers such as NOMEX® and Kevlar®, respectively, and the like.

One commercially available example of a drive belt suitable for use with the present invention is manufactured by Belt Corp of America, Model GBL-138×1.75×.170B1/Blk. In this aspect, the belt construction is as follows: Top Material=Blue Neoprene Duro 65-70A, Tie Stock=R16 Black Neoprene, Cord=35/36 RFL-CR treated Kevlar Cord, Jacket=SU/PF-Fabric RFL-CR treated nylon, Bottom Stock=R16 Black neoprene Duro 70A.

The width of each of the drive belts 200 is preferably between about 0.25 inches and 3 inches. More preferably, the width of each of the drive belts 200 is between about 0.5 inches and about 2.5 inches, and most preferably the width of each of the drive belts is between about 1.5 inches and 2.0 inches. In another embodiment, the width of each of the drive belts 200 is preferably less than about 2 inches. More preferably, the width of each of the drive belts 200 is greater than about 0.5 inches, and most preferably the width of each of the drive belts 200 is greater than about 1.5 inches.

Figure 4:
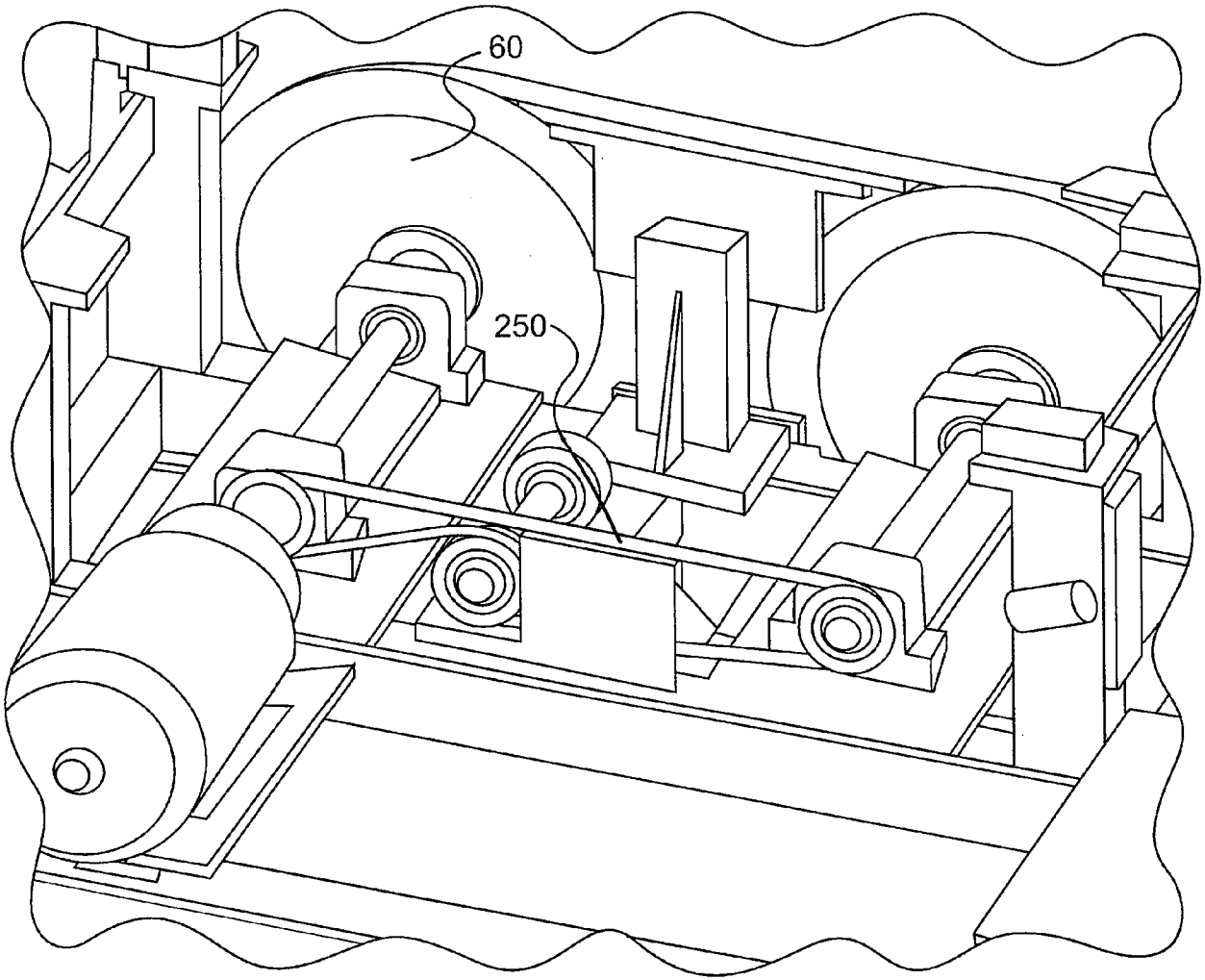
FIG. 4 is a rear view of an exemplary embodiment of the apparatus of the present invention.

According to one embodiment, a redundant belt drive 250 may be included to provide the advantage of minimizing the pulley-to-belt slippage. The redundant belt drive 250 consists of one or more belts, coupling the drive motors to the drive shafts (See FIG. 4.). Other means of providing redundant propulsion of the shafts would include chain drives, gear drives or other methods known by those skilled in the art. In addition, reducing the slippage between drive pulley 62 and belt 200 reduces the requirement for high belt tension, which improves belt life. High belt tension stretches and strains belt materials causing early failure. High belt tension also induces higher bearing loads for shaft bearings. Another advantage of redundant belt drive 250, is to enable reduced belt tension, which also lowers the force is applied to shaft bearings. This benefit reduces machine maintenance and associated downtime by improving shaft bearing life.

Preferably, the drive pulley to belt slippage is less than about 10 revolutions per minute (rpm) at 300 feet per second (fps). More preferably, the drive pulley to belt slippage is less than about 5 rpm at about 300 fps. Most preferably, the drive pulley to belt slippage is less than about 0.5 rpm at 330 fps.

In another aspect of the present invention, the drive pulley to belt slippage is preferably between about 0.25 rpm and about 15 rpm at about 330 fps. More preferably, the drive pulley to belt slippage is between about 0.25 rpm and about 5 rpm at 330 fps. Most preferably, the drive pulley to belt slippage is between about 0.25 rpm and about 2.5 rpm at 330 fps.

In addition to the belt drive assemblies described above, the propulsion system may also include an air propulsion system that is configured and dimensioned to propel an object, preferably a spherical object, such as a golf ball or golf ball component. According to one embodiment, the air propulsion system comprises a pneumatic air cannon 20. Preferably, air cannon 20 is operable to propel a golf ball at any desired, speed, spin, trajectory, and the like. Along these lines, air cannon 20 preferably includes an air reservoir that stores compressed air under high pressure.

Pneumatic air cannon 20 is preferably dimensioned such that it can accommodate variably sized objects. In one embodiment, golf balls and golf ball components may be propelled through air cannon 20. Preferably, however, the interior chamber of air cannon 20 is adjustable such that it can accommodate differently sized spherical objects. Additionally, air cannon 20 preferably includes a valve that limits the amount and duration of air that is fired from air cannon 20. The valve, preferably a Sinclair Collins valve, prevents air from being forced into the barrel of the air cannon 20 after the ball has left the barrel. By preventing air from entering the barrel after the ball leaves, the velocity and/or trajectory of the ball is not affected, which increases accuracy and precision.

An embodiment of the present invention also includes the ability to self-monitor different aspects of the system and apparatus. Specifically, the present invention includes a sensing system that can detect tension of the drive belts. The sensing system may use any desired measurement method known to those skilled in the art including, but not limited to, sound, light, radar, magnetic, and the like. The sensing system may comprise a single sensor, multiple sensors, or a single sensor that includes distributed elements. In situations where distributed elements or multiple sensors are present, they are preferably operatively connected.

An example of a sensor that may be included is a vibration sensor that detects the vibrations caused by moving components of the machine. The vibration sensor preferably measures the vibration in Hertz (Hz), although other units may be used. One example of such a sensor is an IMI Model 645B02. If, for example, the vibration level exceeds a predetermined threshold, the vibration sensor may trigger a fault condition alerting the operator, or cause the machine to stop as to prevent damage to bearings or other periphery equipment.

Preferably, the tension of belt 200 is maintained such that the vibration of the belt remains below about 100 Hz. More preferably, the tension of the belt is adjusted such that the vibration of the belt is maintained below about 50 Hz. Most preferably, the tension of belt 200 is adjusted such that the vibration of belt 200 is maintained below about 25 Hz. In another embodiment, the tension of belt 200 is adjusted such that the vibration of belt 200 is preferably between about 10 Hz and about 200 Hz. More preferably, the tension of belt 200 is adjusted such that the vibration of belt 200 is maintained between about 20 Hz and about 150 Hz. Most preferably, the tension of the belt 200 is adjusted such that the vibration of the belt is between about 30 Hz and about 50 Hz.

The tension of belt 200 may also be described in absolute terms, measured in Newtons (N). Described this way, the tension of belt 200 is preferably between about 10 N and about 200 N. More preferably, the tension of belt 200 is between about 50 N and about 150 N. Most preferably, the tension of belt 200 is between about 75 N and about 125 N. Alternately, the tension of belt 200 is preferably about 50 N or greater. More preferably, the tension of belt 200 is about 100 N or greater. Most preferably, the tension of belt 200 is about 250 N or greater.

It may be desirable for the tolerance of the vibration sensor to be as small as possible. In other words, a vibration sensor that is more accurate and precise is preferred. Along these lines, the sensing system preferably has a tolerance of +/−about 1 Hz. More preferably, the sensing system has a tolerance of +/−about 0.5 Hz. Most preferably the sensing system has a tolerance of +/− about 0.25 Hz.

The sensing system may also include other sensors positioned throughout the apparatus. For instance, a sensor may be included to determine the movement or level of the electric jacks 75, which are described in more detail below. Preferably, each electric jack 75 has an associated sensor 40, although a single sensor 40 may optionally be used to monitor the movement of the jacks if desired. Because the electric jacks 75 provide an inclination ability, the apparatus also includes a sensor 40 for detecting the angle of inclination of the present invention. Other sensors, such as noise sensors, sensors for determining the velocity of the ball positioned within the barrel of air cannon 20, sensors positioned at the end of the barrel of air cannon 20, and the like may be included as desired. As discussed above, each of the sensors included within the sensing system are preferably operatively connected.

One aspect of the present invention includes a pivot point 130 that allows the ball launch angle to be manipulated. Unlike other examples which may pivot the system away from the position of ball launch 120, this invention provides for a pivot point 130 at or near the point of ball launch 120. Pivoting the propulsion system on axis at or near the location of ball launch 120 facilitates monitoring by external equipment such as launch monitors, cameras, light curtains, and the like because of the confined location of the ball position during initial flight.

Figure 2:
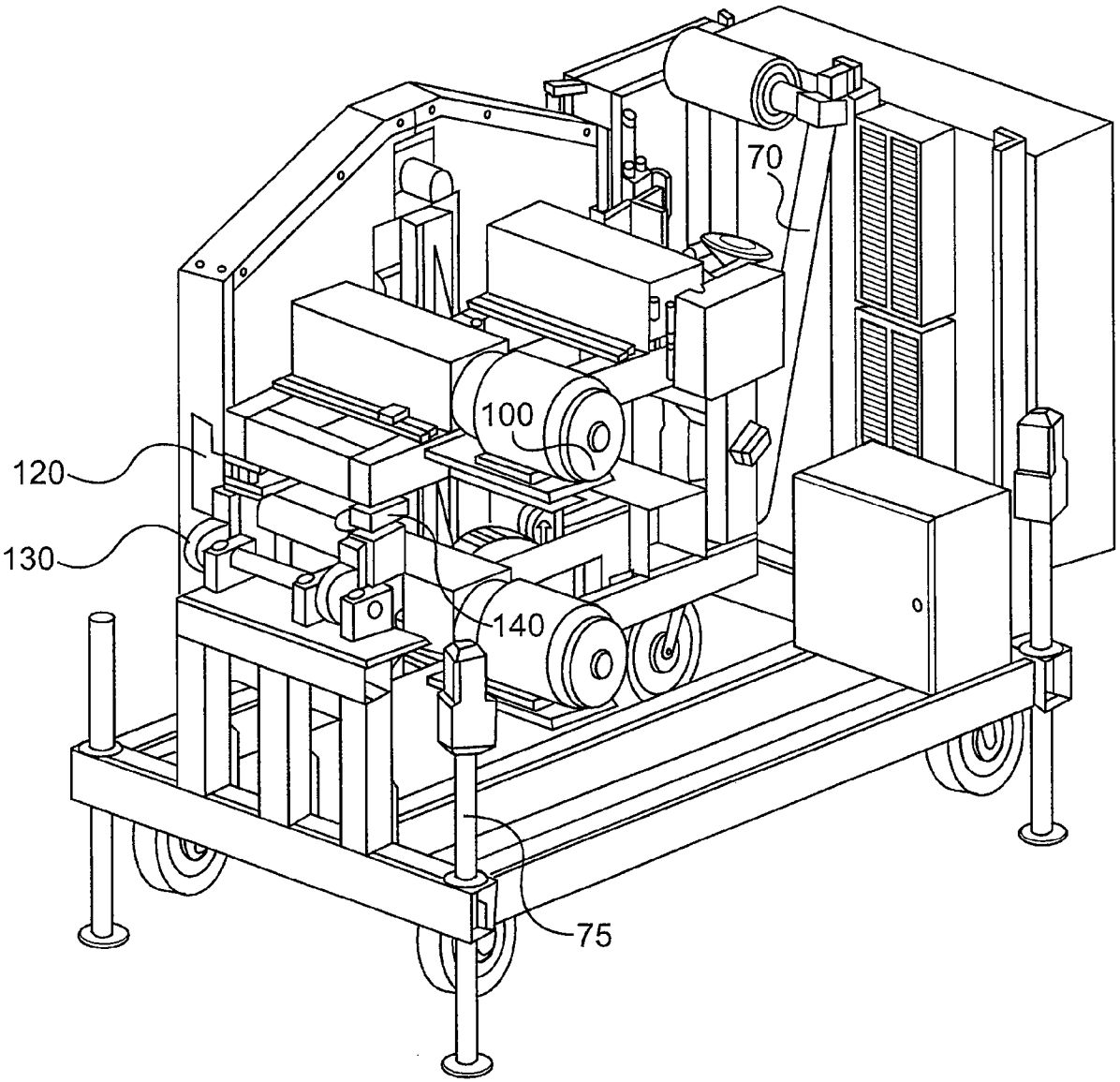
FIG. 2 is a rear orthogonal view showing one exemplary embodiment of the apparatus of the present invention.

In order to accommodate the passage of varying diameters of samples, a method of adjusting for size is desirable. Unlike other examples which utilize jacking screws, a driving wedge system 140 is employed to separate the upper driving belt system 60*a* from the lower driving belt system 60*b* (See FIG. 2). One example of a wedge system is a Unisorb part #LK1 GA-K. By manipulating the gap between upper and lower drive belt frames, and thus belts, samples of varying diameters can be accommodated.

It is desirable for the system and apparatus be configured such that it is durable. In one aspect, equipment maintenance is preferably reduced by using equipment that is resistant to wear and tear. Specifically, as discussed above, the belt materials are made to resist stretching, resist wear, and they are designed to have a high coefficient of friction. The life of the belts employed by the present invention is preferably greater than about 1500 hours. More preferably, the belt life is greater than about 2000 hours. Most preferably, the belt life is greater than about 3000 hours.

Similarly, surfaces that belt 200 must impart against are also selected for their durability. At the area belts 200 come into contact with the sample to impart speed and spin, the belts 200 are supported by a backing material from the underside. This material is used to provide the contact force required of belt 200 to impart precise speed and spin to the sample being launched. Preferably, this belt guide bearing surface should have minimal coefficient of friction as to not impart wear to belt 200. A Delrin on Teflon or combination of low coefficient of friction materials is preferred. These belt guild bearing plates should have a lifetime of about 1500 hours or more. More preferably the belt guild bearing surfaces have a lifetime of about 2000 hours or more. Most preferably the belt guild bearing surfaces have a lifetime of about 3000 hours or more.

In one embodiment, the main belt drive shaft bearing is manufactured utilizing ceramic or ceramic coated bearings. An exemplary belt drive shaft bearing that may be used is manufactured by Fafnir or Timken. In particular, a model called "Super Precision" may be used, having part numbers MM210K and MM205K. Preferably, the lifetime of the main belt drive shaft bearing is about 3500 hours or more. More preferably, the lifetime of the main belt drive shaft bearing is about 4500 hours or more. Most preferably, the lifetime of the main belt drive shaft bearing is about 5500 hours or more.

The apparatus may also include an electric motor 100. Though any electric motor known to those skilled in the art may be used, an electric motor manufactured by Baldor, part number IDNM3777T, having about 7.5 horse power, is preferred. Electric motor 100 preferably has a lifetime of about 12,500 hours or more. More preferably, electric motor 100 has a lifetime of about 16,000 hours or more. Most preferably, however, electric motor 100 has a lifetime of about 20,000 hours or more.

In one embodiment, the tension or idler drive shaft bearings are also manufactured utilizing ceramic or ceramic coated bearings. An exemplary tensioner drive shaft bearing that may be used is manufactured by Fafnir or Timken, model "Super Precision," having part number MM208K. Preferably, the idler shaft has a lifetime of about 12,500 hours or more. More preferably, the idler shaft has a lifetime of about 16,000 hours or more. Most preferably, the idler shaft has a lifetime of about 20,000 hours or more.

Manipulating the angle of inclination of the apparatus is one way to manipulate the launch angle of an object. This may be accomplished by including at least one, and preferably multiple electric jacks that are operable to elevate the apparatus. For instance, four electric jacks 75 may be used in an embodiment where the apparatus has a substantially square shape, with an electric jack 75 positioned at each corner of the apparatus. In alternate embodiments, a single jack 70 may be positioned in the center of the apparatus to raise the part of or the entire apparatus.

In order to ensure the safety and durability of the apparatus, the present invention also includes retaining bars 110 that prevent the elements discussed herein from disengaging or otherwise dislodging from their proper position. In one exemplary embodiment, the present invention includes shaft and pulley retaining bars 110, as shown in FIG. 3. One advantage of using shaft and pulley retaining bars 110 is that they provide a mechanical stop in the event of severe shaft or pulley failure, which may prevent further damage from being inflicted on the apparatus.

Performance

Using the apparatus described above, the present invention is operable to achieve various desirable performance characteristics. For instance, it is desirable to launch a golf ball at a variety of velocities in order to deter mine the aerodynamic lift and drag coefficient characteristics of a golf ball. The ability to launch a golf ball at a wide range of velocities is important because golf ball manufacturers often need to determine a golf ball's aerodynamic characteristics that would result from being struck by different clubs.

As described above, the present invention includes a passage 150 through which an object may be fired from a pneumatic air cannon. Passage 150 allows the object to pass through and have a desired speed and spin imparted to it. Along these lines, the present invention is operable to achieve a ball velocity between about 100 miles per hour (mph) and about 150 mph. More preferably, the present invention is operable to achieve a ball velocity between about 70 mph and about 175 mph. Most preferably, the present invention is operable to achieve a ball velocity between about 35 mph and about 330 mph.

In another embodiment, the present invention is operable to achieve a ball velocity of greater than about 30 mph. More preferably, the present invention is operable to achieve a ball velocity of greater than about 200 mph. Most preferably, the present invention is operable to achieve a ball velocity of greater than about 300 mph.

While a wide variety of ball velocities is desirable, the present invention is also operable to repeatedly generate a given velocity within a predetermined tolerance. In other words, it is desirable for the present invention to be able to repeatedly launch an object at the same desired velocity. For example, if a golf ball manufacturer wants to launch a golf ball at 200 mph, it is preferred that the golf ball can be launched at 200 mph with a shot to shot deviation within a certain tolerance. In this aspect of the invention, "tolerance" means the precision of attaining a desired predetermined speed and/or spin rate. In particular, the tolerance with regard to velocity is less than +/−about 4 mph. In one embodiment, a plurality of balls are launched at a predetermined velocity with a tolerance of +/−about 2 mph. In another embodiment, the tolerance with regard to velocity is less than about +/−about 1 mph. In yet another embodiment, the plurality of balls are launched at a predetermined velocity with a tolerance of +/−about 0.5 mph.

In one embodiment, the speed of each of the drive belts 60 may be manipulated to impart backspin on the object. One way to describe the backspin of the object is the backspin in terms of revolutions per minute (rpm) when the object is within a particular speed range. Preferably, the present invention is operable to generate backspin of about 5000 rpm or greater at speeds between about 50 mph and about 175 mph. More preferably, the present invention is operable to generate backspin of about 10,000 rpm or greater at speeds between about 50 mph and about 175 mph. Most preferably, the present invention is operable to generate backspin of about 15,000 rpm or greater at speeds between about 50 mph and about 175 mph.

In other embodiments, the present invention is preferably operable to generate backspin of about 2500 rpm or greater at speeds between about 175 mph and about 225 mph. More preferably, the present invention is operable to generate backspin of about 4500 rpm or greater at speeds between about 175 mph and about 225 mph. Most preferably, the present invention is operable to generate backspin of about 6500 rpm or greater at speeds between about 175 mph and about 225 mph.

Accurately and precisely generating backspin is preferable in order to ensure the reliability of testing of objects fired from the present invention. As such, the present invention is preferably operable to generate a desired backspin within a tolerance of less than +/−about 6% between speeds of about 0 mph and about 225 mph. In one embodiment, the desired backspin is achieved within a tolerance of less than +/−about 5%, preferably about 4%, between speeds of about 0 mph and about 225 mph. In another embodiment, the desired backspin is achieved between speeds of about 0 mph and about 225 mph within a tolerance of less than +/−about 3%, preferably about 2%.

The apparatus of the invention is also capable of precisely firing a plurality of balls within certain repeatability. As used herein, "repeatability" refers to the fired ball deviation or variance between fired balls at a desired speed and/or spin rate. For example, a plurality of balls may be launched at a predetermined velocity with a repeatability of less than +/−about 0.2 mph. In one embodiment, the plurality of balls are launched at a predetermined velocity with a repeatability of less than +/−about 0.15 mph. In another embodiment, the plurality of balls are launched at a predetermined velocity with a repeatability of less than +/−about 0.1 mph. In addition, a plurality of balls may be launched at a predetermined spin rate with a repeatability of less than +/−about 2%. In one embodiment, the plurality of balls are launched at a predetermined spin rate with a repeatability of less than +/−about 1%. In another embodiment, the plurality of balls are launched at a predetermined spin rate with a repeatability of less than +/−about 0.5%.

According to one aspect, the present invention is able to launch an object with a predetermined angle relative to the ground. For the purposes of this description, it is assumed that the ground is a completely flat surface that has an angle of zero degrees. The foregoing description of launch angles is discussed in reference to the zero degree angle of the flat surface, e.g., the ground.

It is desirable for the present invention to be operable to launch an object with a wide range of launch angles. Accordingly, the present invention is may launch an object at an angle of between about −15 degrees and about 35 degrees. More preferably, the present invention is operable to launch an object at an angle of between about −10 degrees and about 30 degrees. Most preferably, the present invention is operable to launch an object at an angle of between about −5 degrees and about 25 degrees.

Another way to describe the launch angle capability of the present invention is by its total range. For example, if the present invention is operable to launch a golf ball between 5 degrees and 90 degrees then its total range would be 85 degrees. Preferably, the total range of the present invention is about 20 degrees or greater. More preferably, the total range of the present invention is about 50 degrees or greater. Most preferably, the total range of the present invention is about 100 degrees or greater.

One embodiment of the present invention is also able to repeatedly launch an object at a particular angle. Preferably, the present invention is operable to repeatedly launch an object at a desired angle within +/−about 5 degrees. More preferably, the present invention is operable to repeatedly launch an object at a desired angle within +/−about 1 degree. Most preferably, the present invention is operable to repeatedly launch an object at a desired angle within +/−about 0.5 degrees.

One advantage of the present invention is that it is accurately and precisely able to launch an object at a desired angle, with a desired speed and spin, as described above. A result of the accuracy and precision is that the present invention may repeatedly launch and object towards another object with accuracy and precision. Preferably, at a distance of about 70 feet the present invention is operable to repeatedly strike a target within about 12 inches at a speed of about 160 mph and a backspin of about 3000 rpm. Alternately, at a distance of about 70 feet the present invention is operable to repeatedly strike a target within about 12 inches at a speed of about 60 mph and a backspin of about 4500 rpm.

The electric jacks 75, according to one aspect, may be positioned at each corner of the present invention to adjust lateral leveling. Preferably, jacks 75 are operable to adjust the level of the present invention about 1 degree or more. More preferably, the jacks are operable to adjust the level of the present invention about 10 degrees or more. Most preferably, jacks 75 are operable to adjust the level of the present invention about 30 degrees or more. In another embodiment, jacks 75 are operable to adjust the level of the present invention between about 1 degree and about 10 degrees. More preferably, jacks 75 are operable to adjust the level of the present invention between about 1 degree and about 40 degrees. Most preferably, jacks 75 are operable to adjust the level of the present invention between about 1 degree and about 50 degrees.

Control System

One aspect of the present invention preferably includes a computer system 90. The computer system 90 typically comprises a programmed general-purpose computer system, such as a personal computer, workstation, server system, and minicomputer or mainframe computer. Computer system 90 includes one or more processors (CPUs), input/output circuitry, network adapters, and memory. CPUs execute program instructions in order to carry out the functions of the present invention. Typically, CPUs are one or more microprocessors, such as an INTEL PENTIUM® processor. The computer system may comprise multi-processor computer systems, in which multiple processors share system resources, such as memory, input/output circuitry, and network adapters.

Input/output circuitry provides the capability to input data to, or output data from, the computing system. For example, input/output circuitry may include input devices, such as keyboards, mice, touch pads, trackballs, scanners, and the like, output devices, such as video adapters, monitors, printers, and the like, and input/output devices, such as, modems and the like.

The memory stores program instructions that are executed by, and data that are used and processed by, CPUs to perform various functions. The memory may include electronic memory devices, such as random-access memory (RAM), read-only memory (ROM), programmable read-only memory (PROM), electrically erasable programmable read-only memory (EEPROM), and flash memory, and electromechanical memory, such as magnetic disk drives, tape drives, and optical disk drives, which may be used as an integrated drive electronics (IDE) interface, or a variation or enhancement thereof, such as enhanced IDE (EIDE) or ultra direct memory access (UDMA), or a small computer system interface (SCSI) based interface, or a variation or enhancement thereof, such as fast-SCSI, wide-SCSI, fast and wide-SCSI, etc, or a fiber channel-arbitrated loop (FC-AL) interface.

The present invention may also include an operating system that runs on the processor, including UNIX®, OS/2®, and Windows®, each of which may be configured to run many tasks at the same time, e.g., a multitasking operating systems. In one aspect, the present invention may be operable to communicate with a wireless communication and/or computation device, such as a mobile phone, personal digital assistant, personal computer, and the like. Moreover, the computing system may be operable to wirelessly transmit data to wireless or wired communication devices using a data network, such as the Internet, or a local area network (LAN), wide-area network (WAN), cellular network, or other wireless networks known to those skilled in the art.

In one embodiment of the present invention, a graphical user interface may be included to allow human interaction with the computing system. The graphical user interface may comprise a screen, such as an organic light emitting diode (OLED) screen, liquid crystal display (LCD) screen, thin film transistor (TFT) display, and the like. The graphical user interface preferably generates a wide range of colors, although a black and white screen may be used.

It may also be desirable for the graphical user interface to be touch sensitive, and it may use any technology known to skilled artisans including, but not limited to, resistive, surface acoustic wave, capacitive, infrared, strain gauge, optical imaging, dispersive signal technology, acoustic pulse recognition, frustrated total internal reflection, and diffused laser imaging. To aid with the clarity of the screen, the graphical user interface preferably includes a anti-reflective screen or a trans-reflective screen.

In one embodiment, the graphical user interface preferably includes a screen that is about 10 inches diagonal or greater. More preferably, the graphical user interface includes a screen that is about 12 inches diagonal or greater. Most preferably, the graphical user interface includes a screen that is about 14 inches diagonal or greater.

It is contemplated that the present invention may be used in a lighted environment, although it may be used in dark environments as desired. However, in order to be viewable to a user or operator, the graphical user interface preferably has a desirable brightness that may be measured in NITs, which skilled artisans will recognize as a measurement of light in candelas per meter square ($Cd/m^2$). Preferably, the brightness of the graphical user interface is about 400 nit or greater. More preferably, the brightness of the graphical user interface is about 600 nit or greater. Most preferably, the brightness of the graphical user interface is about 800 nit or greater.

One feature of the present invention is that the user interface allows on-screen programming of the system and apparatus of the present invention. In this manner, an operator of the system may specify different characteristics of a test or testing sequence. For instance, it may be desirable to create a testing sequence for a particular object that varies different launch parameters. To do so, the present invention provides the ability to create a test program, using the user interface, that varies parameters such as launch angle, velocity, spin, e.g., backspin and sidespin, a machine vibration limit, and the number of balls to be tested per test program.

The features described above for the test program comprise features of the present apparatus and system that may be varied. However, under certain circumstances it may be desirable for outside variables to be accounted for during testing. The outside features may include air pressure, air temperature, humidity, dew point, wind conditions, and the like. The present invention may be used in combination with launch monitors, which are devices that determine the kinematic characteristics of golf objects, e.g., golf balls and golf clubs. Combining a launch monitor with the ability to input and account for outside variables allows a potential golf ball manufacturer to determine the effect of the outside variables on the golf ball kinematics when a golf ball is launched with known properties, such as launch angle, velocity, and spin. Examples of launch monitors that may be used in combination with the present invention include U.S. Pat. Nos. 7,395,696, 7,369,158, 7,143,639, 6,781,621, and 6,758,759, the entireties of which are incorporated herein by reference.

As mentioned above, it is often desirable to test a plurality of golf balls in a single test. In such an embodiment, a set of golf balls are fired at predetermined intervals. The predetermined interval between firings is preferably selected so that subsequent golf balls do not interfere with the flight of another golf ball, and so that a launch monitor may monitor the kinematic characteristics of one golf ball at a time. Preferably, about six or more golf balls may be tested per test. More preferably, about 12 or more golf balls may be tested per test. Most preferably, about 24 or more golf balls may be tested per test.

Oftentimes manufactures want to compare the aerodynamic characteristics of one type of golf ball against the aerodynamic characteristics of another type of golf ball. To do so, the launch characteristics of the different types of balls should be the substantially similar. As such, the present invention provides the ability to save a particular test configuration as a test menu. The saved test menu may then be selected each time a particular test needs to be implemented. For instance, this may allow a golf manufacturer to compare the coefficient of lift or coefficient of drag of two different golf balls given the same launch conditions. This may be accomplished by providing user input using the graphical user interface.

The user interface may also be used to set other variables of the present invention. The angle of inclination, for example, may be adjusted by setting the leveling jacks 75 to a predetermined level. The sensing device for the angle of inclination, which may be operatively connected to the computing system, provides feedback that allows the computing system to determine when the desired angle of inclination has been reached. In addition, the present invention provides the ability to adjust the level of leveling jacks 75 to account for the angle of the surface under the machine. In other words, if the angle of inclination under the surface of the machine is determined to be 5 degrees, and the user inputs a desired inclination angle of 15 degrees, leveling jacks 75 may be adjusted to an angle of ten degrees (10 degrees for the leveling jacks+5 degree inclination of the surface=15 degrees inclination).

Occasionally, elements of the present invention may become faulty, either due to mechanical or electrical failure. When such a failure occurs, it is desirable to provide a self-diagnosis capability that can isolate and/or determine where the failure has occurred. To enable such a functionality, the present invention includes a self-diagnosis feature that provides feedback to the operator through the user interface. Although it is contemplated that every aspect of the present invention maybe monitored, and appropriate feedback provided, exemplary aspects of the self-diagnosis system are provided as examples below.

In one aspect, the present invention includes one or more velocity monitoring sensors positioned in, on, or around the firing barrel and/or the passage 150 between the belt drive assemblies 60. Preferably, at least one sensor is positioned within the firing barrel in order to verify that the speed of the object as it is being fired through the barrel matches the speed setting selected by a user. At least one sensor may be operatively connected to the computing system 90 to provide it with velocity measurements. Computing system 90, in turn, may compute any variation between the measured velocity and the velocity setting that is requested. If there is a discrepancy, computing system 90 is able to adjust the velocity setting by a predetermined amount in order to provide the appropriate velocity. Optionally, the computing system may enter a self-diagnosis operation, either automatically or when manually requested to do so, in order to perform test firings that allow it to more accurately compute the discrepancy.

For instance, if a user sets a desired ball velocity to 200 fps, and the velocity sensor detects a velocity of 190 fps, it may adjust the velocity of air cannon 20 by 10 fps. Because computer system 90 has determined that the actual velocity is 10 fps less than the requested velocity setting, this is appropriate. In other situations, the discrepancy between the requested velocity setting and the actual velocity may not be linear. In these situations, computing system 90 may determine that more tests are necessary in order to determine the discrepancy between the set velocity and the actual velocity. To do so, the computer may provide an indication on the user interface that tells a user that an error has been detected and that further self-diagnosis is necessary. When the user provides an input that indicates that it is acceptable to perform the self-diagnosis, computing system 90 may fire a series of objects from the firing barrel to measure the discrepancy at various velocity settings. In this manner, the computing system may determine a mathematical algorithm that describes that difference between the set velocity and the actual velocity.

In other embodiments, the testing may be performed automatically, without manual intervention, e.g., user input. However, for the sake of safety, the testing is preferably performed without firing objects from the barrel. Alternately, the computing system may determine that the discrepancy between the actual velocity and the set velocity is too great to carry out accurate ball launching. If this is the case, the computing system preferably provides an indication to the graphical user interface that repair is necessary.

Other sensors may also provide feedback to the computing system in a manner similar to that described above with respect to the velocity sensor. In one example, the vibration/noise sensor may trigger an alarm when vibration and/or noise exceeds a predetermined threshold. Similarly, an inclination sensor may also provide feedback regarding the angle of inclination, and adjustments may be made as necessary in a manner similar to that described above.

In the event of an emergency, where sensor levels exceed predetermined levels, the present invention may provide an emergency shutdown or stoppage feature. In some embodiments, the main moving parts are the pulleys and the drive assembly. Thus, it is particularly necessary to provide an emergency mechanism to prevent these elements from damaging themselves or other elements of the present invention. As such, the present invention includes an electronic brake that can rapidly stop the drive assembly pulleys.

One way to describe the stopping ability of the electronic brake is the time it takes the brake to stop a pulley from a given velocity. Preferably, the electronic brake is operable to stop a pulley in less than about 60 seconds from a velocity of about 330 fps. More preferably, the electronic brake is operable to stop a pulley in less than about 45 seconds from a velocity of about 330 fps. Most preferably, the electronic brake is operable to stop a pulley in less than about 30 seconds from a velocity of about 330 fps.

Automation

The features of the present invention discussed above are preferably automated in order to reduce the need for human intervention, which can cause delays, increase costs, and result in equipment malfunctions. The present invention therefore provides the ability to automatically cycle a plurality of objects through a test sequence. The balls, however, are placed into a magazine or tray system 15 manually by a user. The magazine or tray system 15 provides a place to orient and store a set of objects until they are ready to be fired from the apparatus of the present invention.

Preferably, a magazine or tray system 15 is operable to store about six or more objects. More preferably, a magazine or tray system 15 is operable to store about 12 or more objects. Most preferably, a magazine or tray system 15 is operable to store about 24 or more objects. Each of the balls is preferably manually oriented in a predetermined manner, e.g., with the parting line facing upwards, prior to being inserted into the magazine or tray system 15.

According to an exemplary method of the present invention, one or more golf balls are positioned into the tray system 15 in a predetermined orientation. The launch angle may then be set as desired. The balls are then moved from tray system 15 to air cannon 20 using any mechanical means known to those skilled in the art. Skilled artisans will recognize that one or more balls may be inserted into air cannon 20 at one time. If only one ball is able to be inserted into air cannon 20, the remaining balls may be left in tray system 15 or they may be transferred to a separate reservoir that will allow their insertion into air cannon 20 to be facilitated.

During their movement from tray system 15 to the air cannon 20, the balls are preferably maintained in the same orientation that they had when they were placed into tray system 15. This provides the advantage of allowing the golf balls to be launched in an orientation that is known to the user. Moreover, when used in combination with image acquisition devices and/or launch monitors, the golf balls typically have markers or other indicia positioned on their surface. Orienting and launching the golf balls in a known orientation provides the additional advantage of allowing any markers or other indicia to be visible to the image acquisition devices.

Following the loading of the golf balls into air cannon 20, the drive belts 60 are automatically set to a particular speed according to the speed and spin that are desired for launching the balls. Recall that the speed of each of drive belts 60 may be manipulated independently to impart a particular speed and spin on the golf ball. Additionally, the firing air pressure of air cannon 20 is automatically set, and the ball is then fired via an air cannon 20 and into passage 150 between drive belts 200.

The present invention may optionally include a sensor at the end of the passage between the drive belts that captures the velocity and spin imparted to the ball when it leaves the apparatus of the present invention. In such an embodiment, the velocity and spin are captured and sent to the computing system which records and/or analyzes this information. This process is preferably repeated until all of the balls in tray system 15 have been fired, or, if there are a large number of balls in the tray system, until the predetermined number of balls set by the user have been fired. If all of the balls in tray system 15 have been fired, the tray may be returned to a loading position so that it can be reloaded. If desired, however, a user may enter a command using the user interface to manually force tray system 15 to be returned to the loading position.

Those skilled in the art will recognize that the method described above is one exemplary manner in which the present invention may be used. The steps and descriptions above may be rearranged or implemented in a different order as desired by a those skilled in the art. Moreover, the orientation and insertion of the golf balls into the tray system may be automated using systems and methods that are well known to those skilled in the art.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents. Furthermore, while certain advantages of the invention have been described herein, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

We claim:

1. An apparatus for launching a ball comprising:

a computer system or similar device to receive, store, and execute a plurality of user determined launch parameters; and a propulsion system operatively connected to the computer system comprising:

an air cannon;

a belt drive system comprising an adjustable passage between at least two belts, wherein the at least two belts are coupled to a plurality of drive assemblies, and wherein the distance between the plurality of drive assemblies are adjustable;

a plurality of automatically controlled electric jacks capable of adjusting ball launch angle about a pivot point, wherein the pivot point is located in the proximity of the exit from the belt drive system; and a sensing system, wherein the propulsion system is capable of automatically loading a plurality of balls into the air cannon while maintaining orientation of the plurality of balls, wherein the air cannon is positioned to shoot a ball into the belt drive system to impart velocity and spin to launch the plurality of balls, and wherein the speed of the belt drives is controlled by the computer system or similar device.

2. The apparatus of claim 1, wherein the launch parameters comprise at least one of launch angle, velocity, and spin rate.

3. The apparatus of claim 2, wherein the plurality of automatically controlled electric jacks is capable of adjusting the launch angle by more than about 30 degrees.

4. The apparatus of claim 1, wherein the belt drive system further comprises a driving wedge system coupled to the drive assemblies to adjust the size of the passage.

5. The apparatus of claim 1, wherein the apparatus is automatically adjustable to impart backspin of at least about 5000 rpm at a velocity of about 50 mph to about 225 mph.

6. The apparatus of claim 1, wherein the apparatus is automatically adjustable to impart backspin of at least about 2500 rpm at a velocity of about 50 mph to about 225 mph.

7. The apparatus of claim 1, wherein the apparatus is automatically adjustable to launch a ball at a velocity of between about 35 mph and 330 mph.

8. The apparatus of claim 3, wherein the electric jacks are capable of pivoting the launch angle from about −15° to about 35° relative to a horizontal surface.

9. The apparatus of claim 1, wherein a plurality of balls may be launched at a predetermined velocity with a repeatability of less than +/−0.2 mph.

10. The apparatus of claim 1, wherein a plurality of balls may be launched at a predetermined spin rate with a repeatability of less than +/−2%.

11. The apparatus of claim 1, wherein the at least two belts are constructed to withstand linear or rotational speeds of at least 300 fps.

12. The apparatus of claim 1, wherein the at least two belts comprise a first exterior surface comprising friction enhancing compounds to aid in adhesion of the belt to the drive pulleys, a second exterior surface comprising friction enhancing compounds to aid in propelling the plurality of balls through the at least two belts, and at least one interior layer disposed between the first and second exterior surfaces comprising durable compounds and fibers to aid in extending life of the at least two belts and preventing stretching of the at least two belts.

13. The apparatus of claim 1, further comprising a redundant belt drive system coupled to the belt drive system.

14. The apparatus of claim 1, further comprising a belt tensioner.

15. The apparatus of claim 1, wherein the sensing system comprises a ball velocity sensor.

16. The apparatus of claim 1, wherein the sensing system comprises a ball spin sensor.

17. The apparatus of claim 1, wherein the sensing system comprises at least one sensor.

18. An apparatus for launching a ball comprising:

a computer system or similar device to receive, store, and execute a plurality of user determined launch parameters comprising at least one of ball velocity, ball spin, launch angle, and number of balls to be launched;

a propulsion system operatively connected to the computer system and capable of automatically loading a plurality of balls into an air cannon in a preset orientation, wherein the air cannon is positioned to shoot a ball into an adjustable passage between at least two belts, wherein the at least two belts are coupled to a plurality of belt drives and impart velocity and spin to launch the ball, wherein the height of the belt drives is adjustable to form the adjustable passage, wherein the speed of the belt drives is controlled by the computer system or similar device, and wherein the propulsion system is capable of being automatically pivoted on an axis at or near the exit point of the adjustable passage to adjust the launch angle via a plurality of electric jacks.

19. The apparatus of claim 18, wherein the apparatus is capable of launching the plurality of balls at a predetermined velocity with a repeatability of less than +/−0.2 mph.

20. The apparatus of claim 18, wherein the apparatus is capable of launching the plurality of balls at a predetermined spin rate with a repeatability of less than +/−2%.

21. The apparatus of claim 18, wherein the apparatus is capable of launching the plurality of balls at a predetermined velocity within a tolerance of less than +/−2 mph.

22. The apparatus of claim 18, wherein the apparatus is capable of launching the plurality of balls at a predetermined spin rate within a tolerance of less than +/−6%.

23. The apparatus of claim 18, wherein the the launch angle is adjustable by more than about 30 degrees.

24. The apparatus of claim 18, wherein the the launch angle is adjustable from about −15° to about 35° relative to a horizontal surface.

* * * * *